US005850930A

United States Patent [19]

Jönsson et al.

[11] Patent Number: 5,850,930

[45] Date of Patent: Dec. 22, 1998

[54] POURING PART OF A PACKAGE AND OPENING DEVICE THEREFORE

[75] Inventors: Leif Jönsson, Rydebäck; Tommy Nilsson, Eslöv, both of Sweden

[73] Assignee: Tetra Laval Holdings & finance S.A., Pully, Switzerland

[21] Appl. No.: 656,231

[22] PCT Filed: Dec. 3, 1994

[86] PCT No.: PCT/EP94/04031

§ 371 Date: Aug. 19, 1996

§ 102(e) Date: Aug. 19, 1996

[87] PCT Pub. No.: WO95/17339

PCT Pub. Date: Jun. 29, 1995

[30] Foreign Application Priority Data

Dec. 20, 1993 [DE] Germany ..... 43 43 442.8

[51] Int. Cl.[6] ..... B65D 51/22

[52] U.S. Cl. ..... 215/226; 215/228; 220/212; 220/334; 222/83; 222/541.2

[58] Field of Search ..... 215/228, 226, 215/254, 256; 220/212, 334, 335, 277, 278; 222/81, 83, 83.5, 88, 89, 541.2, 556, 562

[56] References Cited

U.S. PATENT DOCUMENTS

| | | | |
|---|---|---|---|
| 1,859,008 | 5/1932 | Stamer | 222/541.2 X |
| 2,006,235 | 6/1935 | Faveri et al. | 222/541.2 X |
| 2,695,738 | 11/1954 | Gordon | 222/562 |
| 3,187,918 | 6/1965 | Moore | 220/227 X |
| 3,335,923 | 8/1967 | Healy | 222/562 |
| 4,185,756 | 1/1980 | Sciamonte | 222/83.5 |
| 4,634,013 | 1/1987 | Bar-Kokhba . | |
| 4,709,830 | 12/1987 | Kreiseder . | |
| 4,867,326 | 9/1989 | O'Meara . | |
| 4,898,293 | 2/1990 | Morel | 222/83 X |
| 5,094,361 | 3/1992 | Dubach | 220/277 X |
| 5,255,813 | 10/1993 | Berggren et al. | 220/278 |
| 5,441,180 | 8/1995 | Woodruff | 222/562 X |
| 5,505,326 | 4/1996 | Junko | 220/212 X |

FOREIGN PATENT DOCUMENTS

| | | | |
|---|---|---|---|
| 0 530 677 A1 | 3/1993 | European Pat. Off. . | |
| 0 531 813 A1 | 3/1993 | European Pat. Off. . | |
| 1 394 164 | 2/1965 | France . | |
| 1 480 164 | 4/1967 | France . | |
| 2 409 929 | 6/1979 | France . | |
| 616408 | of 0000 | Germany | 220/278 |
| 2 252 649 | 10/1972 | Germany . | |
| 43 23 666 A1 | 1/1994 | Germany . | |
| 689814 | 4/1965 | Italy | 220/278 |
| 533045 | 1/1973 | Switzerland . | |

*Primary Examiner*—Stephen K. Cronin
*Assistant Examiner*—Robin A. Hylton
*Attorney, Agent, or Firm*—Michael L. Dunn

[57] ABSTRACT

A device for opening a pouring part (2) attached to the top wall (1) of a package for flowable media and projecting in a raised manner from said top wall (1), is provided with a cap (13) extending over said pouring part (2), which is removably fitted to the pouring part (2). In order that the opening device makes possible a package which can be produced economically, and which can be opened reliably without excessive expenditure of force, it is provided according to the invention that the cap (13) is rotatable over at least approximately 90° in relation to the pouring part (2) and is provided with an internal space (17) and at least one blade (23) projecting into said space (17), which for opening can be inserted into an at least partly annular surface section (5) in order to carry out cutting.

11 Claims, 3 Drawing Sheets

POURING PART OF A PACKAGE AND OPENING DEVICE THEREFORE

Figure 1:
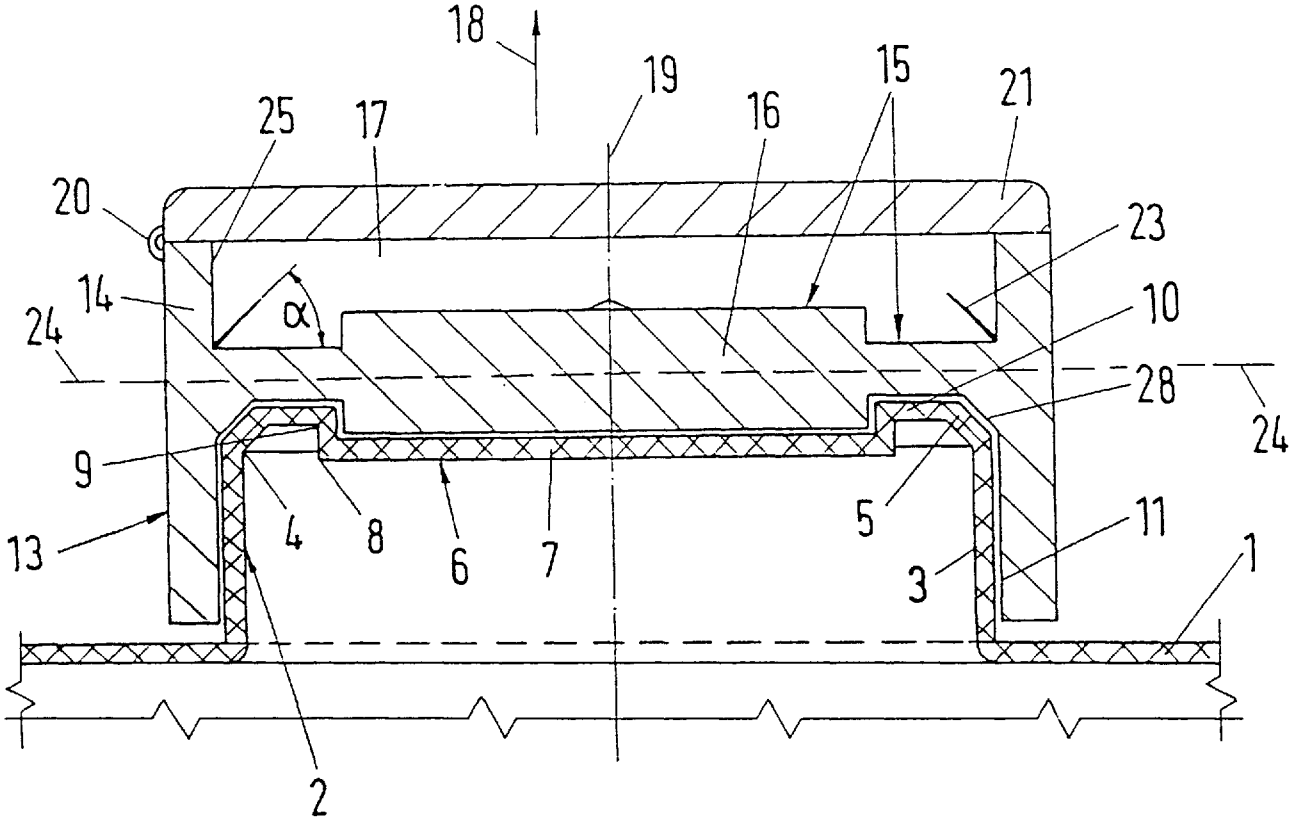

The invention relates to a device for opening a pouring part attached to the top wall of a package for flowable media and projecting in a raised manner from said top wall, having a cap extending over the pouring part and removably fitted to said pouring part.

Opening devices made from plastics have previously been attached to the top wall of a cuboid or gable-ended folded package, provided in the manner previously described with a pouring part and a cap extending over it.

In an earlier proposal made internally within the company, the top wall, made from deep-drawable plastics, was moulded by deep-drawing in the area of the pouring apparatus in such a way that a cylinder-walled, outwardly closed pouring apparatus was formed, opening out only into the interior of the package, on to which a cap was pushed or screwed, but in either case in a removable manner. The pouring part according to this earlier, proposal made internally within the company was provided with a cylindrical-walled collar and a sealing wall attached to its outer end. In the outer periphery of the sealing wall a weakened line was provided and the plate-shaped planar wall of the cap lying adjacent to the sealing wall was welded to the sealing wall. In this way an attempt was made to keep the package completely sealed even though the cap was fitted and welded tight subsequently. In this way, aseptic packaging of contents is made easier. Further, it was desired that when the cap was removed for initial opening, the sealing wall was released from the pouring part along the weakened line and removed with the cap.

In time, however, it was shown that not only the surface of the sealing wall lying inside the weakened line or pre-determined breakage line was torn out during removal, but also a piece of the pouring part. With other designs, the top wall of the cap was torn out as the pre-determined breakage line was not made weak enough.

The object of the invention is therefore to provide an opening device of the type described in the introduction, with which an economically producible package can be reliably opened logically, simply and without excessive expenditure of force, such that apart from the cap, no other part is separated.

This object is solved according to the invention in that the cap is rotatable over at least approximately 90° in relation to the pouring apparatus and is provided with an internal space and at least one blade projecting into said space, which, for opening by means of cutting out, can be inserted into an at least partly annular surface section. With the new opening device the cap no longer needs to be sealed to the pouring part, and in particular manufacturing is more economical because of this because no special pre-determined breakage lines, which also tear reliably when the cap is removed, have to be introduced in the pouring apparatus itself. According to the invention at least one blade is provided in the cap such that for opening it is inserted in the surface section and cuts said section by its rotation. Cutting out in general means less expenditure of force is needed by the end-user than for tearing through a weakened line. In addition, the engagement of a blade and its capacity to cut increases the reliability of the opening procedure. Lastly, the blade can be fitted in such a manner that although the sealing wall which is cut out is separated from the pouring part, it remains attached to the inside of the cap and is reliably retained such that when the cap is removed a further part of the package does not have to be disposed of.

It is also advantageous according to the invention when the pouring part attached to the top wall of the package is provided with a collar protruding from the top wall and a sealing wall attached to its outer end on which the surface section is arranged, and when the surface section together with the collar encloses an angle of 5° to 60°, preferably of 15° to 45°, and particularly preferably of 25° to 35°. It is known to insert a pouring part into the hole in a top wall and to weld it tight onto the top wall. This pouring part must then be sealed by means of the cap, however, as pouring parts used until now are tubular and open. According to the invention, a pouring part can be placed and fixed on a top wall which has a hole in it, however the pouring part itself can be closed on one side. The opening device according to the invention can therefore be particularly preferably used for a pouring part which is deep-drawn from a top wall made from deep-drawable plastics, into, as it were, a cup-shape closed on one side. The pouring part moulded in this manner then has the collar described, the sealing wall on the exterior and in between these the surface section which goes around the outer end of the collar in an annular manner. For particularly effective cutting out, the feature of setting the surface section, which is linear in cross-section, at a specific angle with respect to the collar, which is also linear in cross-section, is provided. The purpose of this arrangement is essentially to provide a good direction of insertion for the cutting blade. In addition, it has also been shown to be particularly preferable when the blade is arranged perpendicular to the surface section.

It is further particularly advantageous according to the invention when the blade is configured planar and at least two, preferably four, blades are attached, distributed around the periphery of the preferably cylindrical internal space in the cap.

It has been stated up until now that, with respect to the configuration of the pouring part, it can be made from a cup-shaped part which is preferably closed on one side by the sealing wall. With the cross-section described hereinabove, wherein the collar and the surface section both appear as straight lines, the section lies in a plane vertical to the top wall of the package.

If a horizontal section is added, which runs parallel to the top wall of the package, and if this is allowed to pass through the collar, different configurations are then possible for the pouring part. The line of intersection between the collar and the cross-section plane parallel to the top wall described can be configured as circular, oval, polygonal or in a similar way. The circle is preferred because it is suitable for machine technology. The space located inside the collar is also "preferably cylindrical" only in a case such as this.

The periphery of the internal space formed by the pouring part, which is located in particular adjacent to the sealing wall, serves to accommodate at least one planar blade. A construction has proved particularly advantageous wherein preferably four blades are arranged distributed around the periphery of the internal space at a distance of approximately 90° apart. Here, blades made from metal or steel can be fixed onto the peripheral wall of the internal space by welding or in another way. It is also conceivable to manufacture and mould the planar blade from the same plastics as the pouring part. However, it is also sufficient to select a material which can be sealed to the plastics material of the pouring part, and to form the blade from this and to fix it onto the internal space.

A particularly advantageous plastics material can be a thermoplastic material, for example polypropene. PVC can also serve as such a material, wherein in the technology polypropene is commonly also known as polypropylene. The top wall or the area around the pouring apparatus which can be deep-drawn out of the top wall, is preferably made from fully re-workable and easily rotting parts and materials. In this case, a plastics material, for example polypropene, can be selected which is filled, wherein chalk, mica, talcum, gypsum or the like is envisaged as the filling material. In practice, degrees of filling of up to 70%, preferably of 60% have proved advantageous. It has been shown that such filled plastics materials are on the one hand easy to rot, can naturally be re-worked or recycled without problems and using simple methods, and on the other hand do not interfere with the properties of a plastics material, so such filled plastics materials are in particular capable of being sealed and are also deep-drawable.

It is also advantageous according to the invention when the blade, seen in the direction of the axis of rotation of the cap, is triangular and its line of intersection with the internal surface of the cap encloses an angle β of 0.50° to 10°, preferably 1° to 6°, and particularly preferably of 2° with the plane lying perpendicular to the axis of the cap. The triangular shape of the blade seen in the direction of the axis of rotation of the cap and therewith the central axis of the internal space of the pouring apparatus is arranged such that the hypotenuse is located on the periphery of the internal space, while the point projects radially inwards towards the centre. When a blade shaped in this manner is brought into engagement with the surface section, as a result of the initiation of cutting, the point of the triangle cuts into the surface section. The pressure and cutting forces concentrated in this way on one point ensure reliable penetration and opening of the surface section. The edges of the triangular blade arranged adjacent to the point serve as cutting knives and when the cap is rotated after the initial piercing of the surface section they cut along a cutting line.

If one looks vertically at the axis of rotation of the cap and the central axis of the internal space, as it were parallel to the top wall, the geometrical line of intersection between the blade and the internal surface of the edge can then be seen. One then looks at the base line or fixing line of the blade, which in the case of the triangular shape is the hypotenuse. In the case of a planar blade this line of intersection is a straight line, which runs neither in the direction of the axis of rotation of the cap nor in the latterly described direction of view parallel to the top wall, but instead at the angle β described with respect thereto. This setting of the plane of the triangular blade against the plane lying perpendicular to the axis of the cap not only enhances cutting but also, when matched with a thread if the pouring part has an external thread and the cap an internal thread, ensures that this angle β is matched to the pitch of the thread so that with the rotation along the thread, the blade moves along the periphery through the surface section in a plane substantially parallel to the sealing wall. Moreover, the blade or the plurality of blades reaches or reach under the cut off sealing wall such that it is reliably retained and can be removed together with the cap. Falling in of the cut-off part of the sealing wall is thus advantageously prevented.

In a further advantageous configuration of the invention, the internal space in the cap is cylindrical and is delimited externally by a protective disc, preferably articulated in a hinge-like manner, and inside by a central body, by means of which a second receiving space, open on one side, is formed in the cap. The construction of this special embodiment of the cap is selected so that preferably the internal space is smaller than the latterly described second receiving space. The internal space is then closed on both sides, while the receiving space is open on one side such that the cap can be placed on the pouring part which is dimensioned accordingly and is also cylindrical. This can again be done by screwing or pushing on, clamping or the like. With this embodiment with the central body, the blades are accommodated by the internal space in the cap in a protected manner so that there is no access to the blades without folding up the protective disc in the manner of a hinge. For initial fitting of such a cap, the receiving space is moved over the pouring part, wherein the two volumes correspond with one another. For opening, the enduser must then firstly open the protective disc, which is articulated in a hinge-like manner, remove the cap, rotate it by 180° and place it, with the internal space opened by folding up the protective disc, onto the pouring part so that the blades engage with the surface section and cut through when rotated.

It is furthermore advantageous according to the invention when the central body is disc shaped with a central and rotationally symmetrically thickened part projecting into both the internal and the second receiving space. The disc shape of the central body should be conceived such that the disc becomes thicker over a certain radius of, for example, half or two thirds of the radius of the disc and is configured annular and thinner in the external area. The pouring part should be moulded with suitable deep-drawing tools set up for this. The sealing wall of the pouring part is then somewhat higher at the edge in an annular manner and is provided with a disc-shaped indentation in the centre. By means of this configuration of on the one hand the central body and on the other hand the sealing wall of the pouring part, it can be seen that the cap can be fastened more tightly onto the pouring part, but above all it can be reliably centred. The design of this central body, configured thickened in the centre, further serves to retain the cut off sealing wall, which where there is a sudden transition from the thickened central part to the thinner outer ring is provided with a crimped stiffening.

Another preferred embodiment of the invention is configured so that the internal space of the cap is cylindrical and is configured deeper than the collar of the pouring part to at least the extent that when the cap is completely in place, the blade does not engage with the surface section of the pouring part, and that the cap is provided on its open side with a tear ring attached by means of a pre-determined breakage line. In contrast to the previously described special first embodiment, when the cap alone is viewed, the internal space is not closed on both sides. When the viewer looks inside the cap the blade or blades can be seen. If the user fits the cap onto the pouring part or if the cap manufacturer places it on the pouring part without desiring to open it, or screws it on, then with the novel second embodiment the blades remain unengaged with the surface section. If the end-user then wishes to open the package, and thereby the pouring part, he will see a tear ring which he must tear along the pre-determined breakage line described before the cap can move further with respect to the pouring part. Only at this point do the blades engage with the surface section, and during rotation or the last part of the rotation, the cutting already described takes place.

A further and preferred embodiment of the invention is characterised in that the internal space of the cap is cylindrical and is configured deeper than the collar of the pouring part by at least the distance of the open side of the cap from the top wall, and that an annular resistance beading or the like is attached to the inside of the cap or the outside of the pouring part. This latterly described embodiment replaces the tear ring with the pre-determined breakage line with the resistance beading, which serves the same functions as the tear ring in the previously described embodiment.

Further advantages, features and possibilities for applications of the present invention will be shown in the following description of preferred embodiments with reference to the drawings. These show in FIG. 1 a cross-sectional view through the pouring part and the cap, wherein the section is made through the axis of rotation of the cap, FIG. 2 a view of the cap in FIG. 1 from above, wherein, however, the protective disc, articulated in a hinge-like manner, is omitted, FIG. 3 a sectional view similar to that in FIG. 1, wherein, however, the angle β between the base and fixing line of the blade to the interior surface of the interior space and the plane perpendicular to the axis of the cap is shown, and FIG. 4 the partly cut away arrangement of the cap during cutting, with the folded-up protective disc.

FIG. 1 shows the first embodiment of the opening device. A cup-shaped pouring part 2 is moulded by deep-drawing from the top wall 1 of the package, which is not shown in more detail, such that the collar 3 projects in a raised manner from the top wall 1. A surface section 5, set at approximately 45°, adjoins the outer end 4 of the collar 3 and merges towards the inside into sealing wall 6. This sealing wall 6 is provided with an indentation extending radially outwards from the centre, which has on its outside an annular raised part 10 divided by crimps 8, 9.

A cap 13 fixed by means of a clamp ring 11 in grooves 12 sits on the pouring part 2. This has a band 14 on the outside, inside which a central body 15 is moulded in the manner of a disc. The Figures clearly show the central and rotationally symmetrically thickened part 16 of the central body 15.

Figure 3:
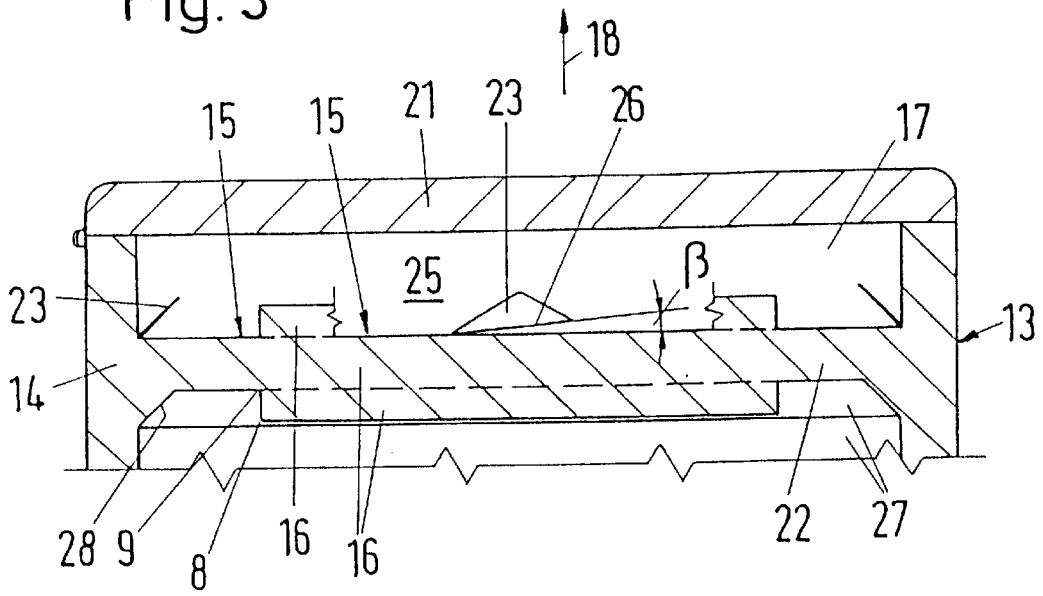
Figure 2:
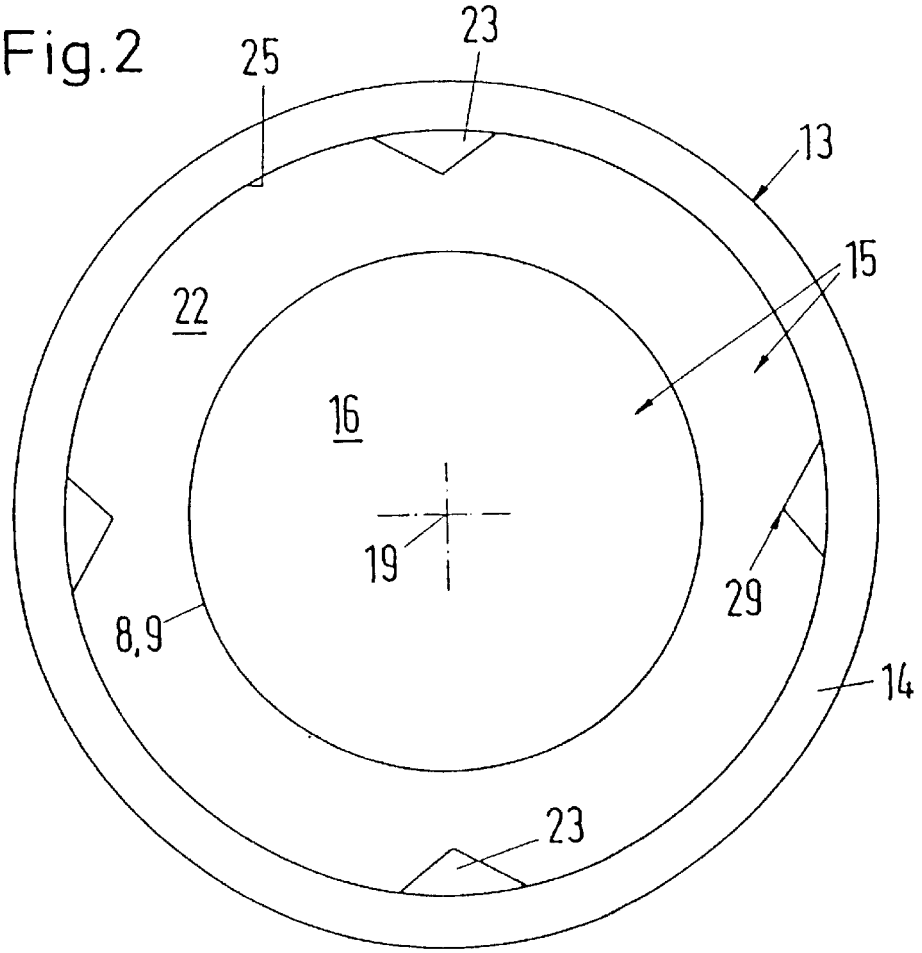

The central body 15 provides a small internal space 17 inside the band 14 of the cap 13, which when the cap 13 is in the closed position according to FIGS. 1 to 3 is located "at the top", that is to say directed away from the top wall 1 in the direction 18 of the axis of rotation 19 of the cap 13. At the top end of the band 14 of the cap 13 a protective disc 21 is articulated by means of the hinge 20. This protective disc 21 is shown closed in the representations in FIGS. 1 and 3, while it is folded up in the state shown in FIG. 4 (cut away).

If one imagines the protective disc 21 folded up or removed, this results in the representation in FIG. 2. Viewed in the direction of the axis of rotation 19 of the cap 13, the central body 15, with the raised thickened part 16 in the form of a disc, is in the centre and the annular thinner part 22 of the central body 15 lies outside it. The step-like crimps 8 and 9 can clearly be seen. Four blades 23 which are triangular in the view shown in FIG. 3, are fitted onto the inner periphery of the band 14 in the internal space 17. In the cross-section according to FIGS. 1, 3 and 4, it can be seen that the plane of the blade 23 lies at an angle a to a plane 24 which must be imagined to be perpendicular to the axis of the cap 19. If the plane of the blade 23 is allowed to intersect the internal surface 25 of the cap 13, the result is a straight line of intersection 26 (FIG. 3) which is also the base or fixing line of the blade 23. This line of intersection 26 encloses an angle β of 2° (FIG. 3) with the plane 24 described (perpendicular to the axis of the cap 19).

In the embodiment of the cap 13 shown in the Figures, the angle α is 45°. It can, however, comprise other angles, similar to the angle not shown in more detail in the Figures which encloses the surface section 5 and the collar 3 of the pouring part 2, which for example are in a range of angles of 5° to 60°, preferably of 15° to 45°, and very particularly preferably of 25° to 35°. It is preferred when the angle which encloses the surface section 5 and the collar 3 is equal to the angle α. In the embodiment shown here, α=45°.

The central body 15 is connected externally by means of its annular thinner part 22 to the band 14 of the cap 13. The central body 15 separated the internal space 17, as previously described, from the larger second receiving space 27, which, in the closed position shown in FIG. 1, receives the pouring part 2.

On the surface facing the internal space 17, the internal surface 25 of the cap 13 and the surface of the annular, thinner part 22 of the central body 15 adjoining it are at right-angles to one another. On the other side, in the receiving space 27 an intermediate surface 28 is provided on the cap which is at the same angle to the internal surface adjoining the second receiving space 27 as the previously described surface section 5 is to the collar 3. In the embodiment shown here, this angle is a 45° angle. It can be seen that the raised, annular external part 5, 10 of the pouring part 2 fits exactly into the base (formed by the central body 15) of the second receiving space 27.

Figure 4:
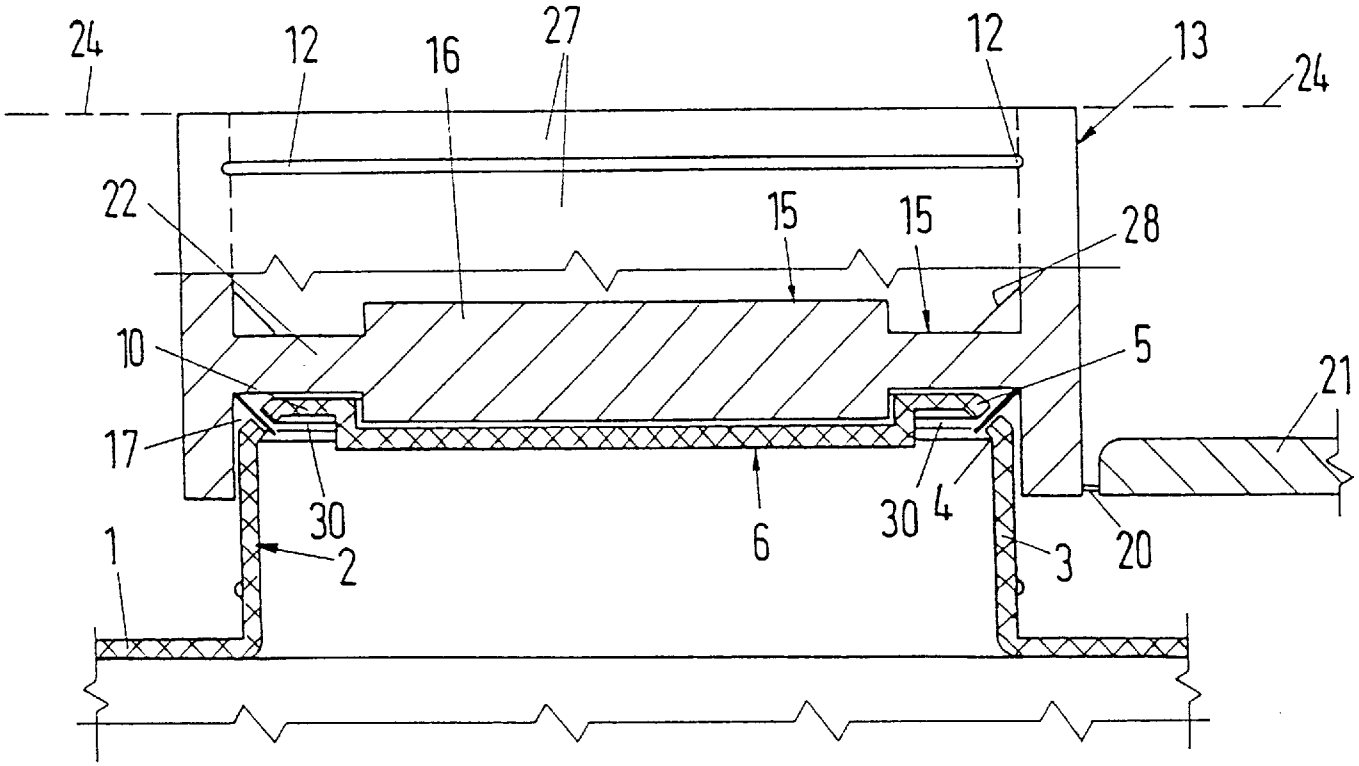

To initially open the pouring part 2, the end-user grips the closed protective disc 21 according to FIGS. 1 to 3, and folds this up about the hinge 20 so that the internal space 17 with the blades 23 is visible. The user then completely removes the cap 13 from the pouring part 2, rotates it by 180°, and replaces it with the internal space 17 over the pouring part 2, as is shown in FIG. 4. The second receiving space is now upwards and empty, and underneath in the internal space 17 the points 29 of the triangular blades can now pierce the surface section 5 and cut it. In the position shown in FIG. 4, the blades 23 have already penetrated into and through the surface section 5 and have already produced the cut line 30 by a partial rotation of approximately 30°. If in the embodiment shown here, the cap 13 is rotated by at least 90°, all the quarter circle cut lines 30 overlap one another, and the sealing wall 6 is on the one hand completely cut away from the pouring part 2 and on the other hand retained by the blades 23 such that when the cap 13 is removed, the sealing part 6 is also removed. The pouring part 2 is opened and the user can pour out the contents.

We claim:

1. The combination of a pouring part with a device for opening the pouring part attached to a top wall of a package for flowable media and projecting in a raised manner from said top wall, wherein the pouring part comprises a collar (3) projecting in a raised manner from said top wall (1), and a sealing wall (6) attached to an outer end (4) of the collar by means of an inwardly directed, at least partly annular surface section (5), said opening device comprising a cap (13) extending over the pouring part (2) and removably fitted to said pouring part (2), said cap (13) is rotatable over at least 90° in relation to the pouring part (2) and has an internal space (17) and at least two blades (23) projecting into said space (17), said blades (23) are insertable into sealing wall (6) upon rotation of the cap (13), wherein the cap (13) is rotatable within a plane without an axial displacement, the surface section (5) together with the collar (3) enclosing in cross section an angle of 5°–60°.

2. A device according to claim 1, wherein at least two blades (23), each of which lies in its own plane, are attached to a periphery of the internal space (17) of the cap.

3. A device according to claim 1, wherein at least four blades (23), each of which lies in its own plane, are attached to a periphery of the internal space (17) of the cap.

4. A device according to claim 2, wherein, seen in a direction (18) of a central axis of rotation (19) of the cap (13), the blades (23) are triangular having a line of intersection (26) which, with an internal surface (25) of the cap (13), encloses an angle β of 0.5° to 10°, with the planes lying perpendicular to the axis of rotation the cap (19).

5. A device according to claim 3, wherein, seen in a direction (18) of a central axis of rotation (19) of the cap (13), the blades (23) are triangular having a line of intersection (26) which, with an internal surface (25) of the cap (13), encloses an angle β of 0.5° to 10°, with the planes lying perpendicular to the axis of rotation the cap (19).

6. A device according to claim 1, wherein the internal space (17) of the cap (13) is cylindrical and is delimited externally by a protective disc articulated in a hinge-like manner, and internally by a central body (15), by means of which a second receiving space (27) open on one side is formed in the cap (13).

7. A device according to claim 2, wherein the internal space (17) of the cap (13) is cylindrical and is delimited externally by a protective disc articulated in a hinge-like manner, and internally by a central body (15), by means of which a second receiving space (27) open on one side is formed in the cap (13).

8. A device according to claim 3, wherein the internal space (17) of the cap (13) is cylindrical and is delimited externally by a protective disc articulated in a hinge-like manner, and internally by a central body (15), by means of which a second receiving space (27) open on one side is formed in the cap (13).

9. A device according to claim 6, wherein the central body (15) is plate-shaped and is provided with a central and rotationally symmetrically thickened part (16) projecting into both the internal space (17) and the second receiving space (27).

10. A device according to claim 7, wherein the central body (15) is plate-shaped and is provided with a central and rotationally symmetrically thickened part (16) projecting into both the internal space (17) and the second receiving space (27).

11. A device according to claim 8, (wherein the central body (15) is plate-shaped and is provided with a central and rotationally symmetrically thickened part (16) projecting into both the internal space (17) and the second receiving space (27).

* * * * *